United States Patent [19]

Westmoreland

[11] Patent Number: 4,462,768

[45] Date of Patent: Jul. 31, 1984

[54] AIR COMPRESSOR

[75] Inventor: Julius C. Westmoreland, Marina Del Rey, Calif.

[73] Assignee: Inotek-Westmoreland Venture, Irvine, Calif.

[21] Appl. No.: 445,160

[22] Filed: Nov. 29, 1982

[51] Int. Cl.[3] ..... F04B 21/02; F04B 39/08

[52] U.S. Cl. ..... 417/518; 417/534; 92/31; 92/33; 92/107

[58] Field of Search ..... 417/510, 518, 534; 92/31, 32, 33, 107; 74/58

[56] References Cited

U.S. PATENT DOCUMENTS

| | | | |
|---|---|---|---|
| 465,099 | 12/1891 | Rice, Jr. | 74/58 |
| 787,223 | 4/1905 | Schwabe | 74/58 |
| 829,279 | 8/1906 | Ripars | 92/33 |
| 1,089,408 | 3/1914 | Ganderton | 92/31 |
| 2,262,963 | 11/1941 | Procissi | 74/58 |
| 3,183,792 | 5/1965 | Allen | 92/107 |
| 4,145,166 | 3/1979 | Justice | 417/534 |

*Primary Examiner*—William L. Freeh
*Attorney, Agent, or Firm*—George J. Netter

[57] ABSTRACT

The described air compressor has an annular piston received within a cylinder for reciprocal movement to drive pressurized air on both piston strokes to an outlet which is arranged in line with the air inlet and driving power source. A shuttle valve alternately opens and closes ports at opposite ends of the pump cylinder to accomplish valving for the pressurized air. Rotative drive applied to an axially located rotor within the compressor housing via a planetary gear assembly alternately drives the rotor in opposite directions. A gear on the rotor is drivingly related to gears located on two threaded shafts which pass through threaded openings in the piston. Accordingly, rotation of the rotor drives the annular piston from one extremity to another in the pump cylinder. The planetary gear mechanism interrelates the input drive shaft to the rotor with the direction of rotation being consecutively switched by shifting a spring clutch from the engaged to the non-engaged condition and back to the engaged condition.

5 Claims, 11 Drawing Figures

5
14
10
85
31
30
32
34
35
39
41
42
37
40
38
44
46
43
33
15
36
52
52
51
45
53
57
50
16
54
17
58
61
56
55
68
68
4
4
60
63
59
62
64
65
80
76
27
27
79
66
78
29
73
73
26
72
72
24
70
82
25
75
71
81
24
75
77
77
74
28
13
12
5

10
11
14
31
30
32
34
36
35
43
33
44
47
48
46
49
19
6
6
67
52
51
57
53
50
67
20
17
16
45
54
61
55
59
56
58
21
60
69
69
63
62
64
80
18
65
79
27
83
78
66
29
73
83
72
24
70
26
25
71
75
24
22
81
82
28
84
84
74
13
12

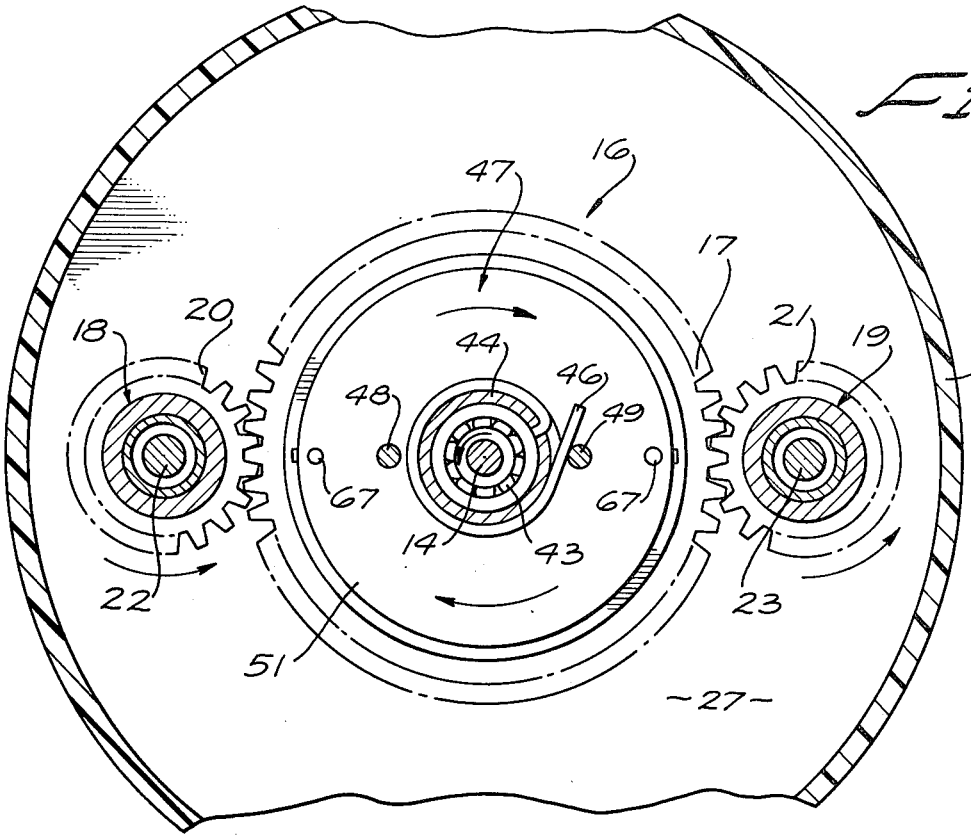
FIG. 6.
FIG. 8.
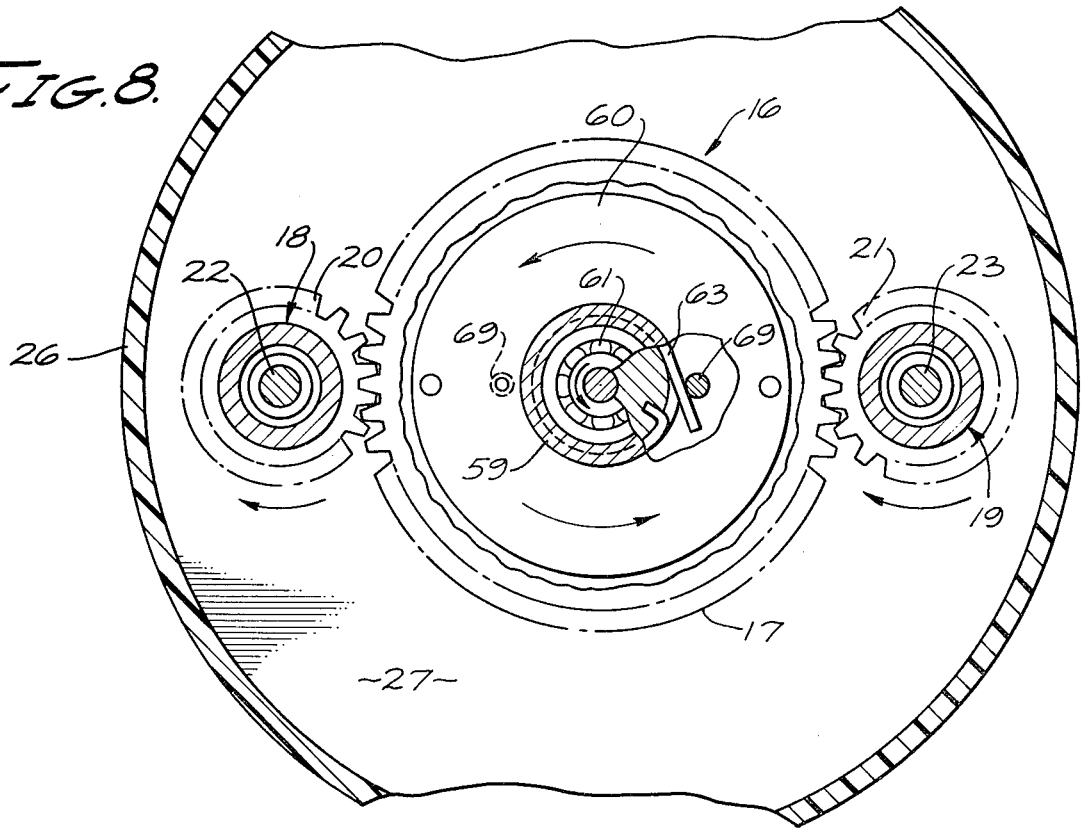

10
11
14
31
30
32
15
34
35
33
36
44
46
43
48
49
47
52
51
53
16
57
20
21
8
8
50
54
56
54
45
61
17
55
59
58
60
69
63
62
69
67
67
64
18
19
65
80
79
27
27
66
78
73
29
76
83
83
9
9
82
22
81
23
26
71
75
25
75
24
72
70
28
74
84
77
12
84
13

AIR COMPRESSOR

The present invention relates generally to an air compressor and, more particularly, to an improved air compressor especially adapted for in-line operation.

SUMMARY

In accordance with the improved air compressor described herein, an annular piston is received within a suitably dimensioned cylinder for reciprocal movement to drive pressurized air on both piston strokes to an outlet line which is arranged in line with the air inlet and driving power source. A centrally located shuttle valve alternately opens and closes ports at opposite ends of the pump cylinder to accomplish valving for the pressurized air. Rotative drive applied to an axially located rotor within the compressor housing via a planetary gear clutch means alternately rotates in opposite directions. A gear on the rotor is drivingly related to gears located on two threaded shafts which pass through threaded openings in the piston. Accordingly, rotation of the rotor drives the annular piston from one extremity to another in the pump cylinder.

The planetary gear mechanism interrelates the input drive shaft to the rotor with the direction of rotation being consecutively switched by shifting a spring clutch from the engaged to the non-engaged condition and back to the engaged condition.

In operation, assuming the spring clutch is engaged, the input rotative drive acting through the planetary gear assembly serves to drive the piston from a first extreme of the cylinder to the other and thereby force pressurized gas outwardly of one set of ports. On reaching the first extremity, the spring clutch means is switched to a second mode of operation thereby causing the planetary assembly to drive the screws shafts in the opposite direction effecting return of the piston to the other extremity of the cylinder. It is this consecutive operation of the spring clutch means that causes a continuously reciprocating drive of the pump alternating the delivery of pressurized gas outwardly of the two sets of ports.

DESCRIPTION OF THE DRAWINGS

FIG. 6 is a top plan, sectional view taken along the line 6—6 of FIG. 5.

FIG. 8 is a top plan sectional view taken along the line 8—8 of FIG. 7.

DESCRIPTION OF A PREFERRED EMBODIMENT

Figure 1:
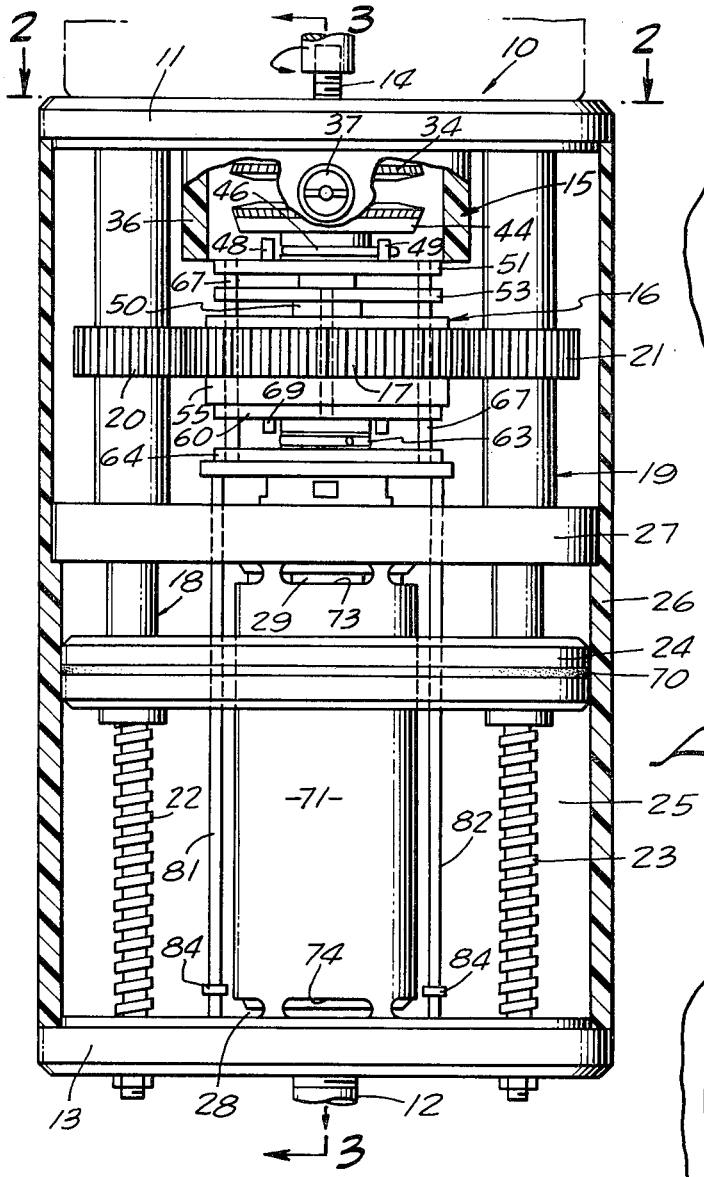
FIG. 1 is a side elevational, partially sectional view of the air compressor described herein.
Figure 4:
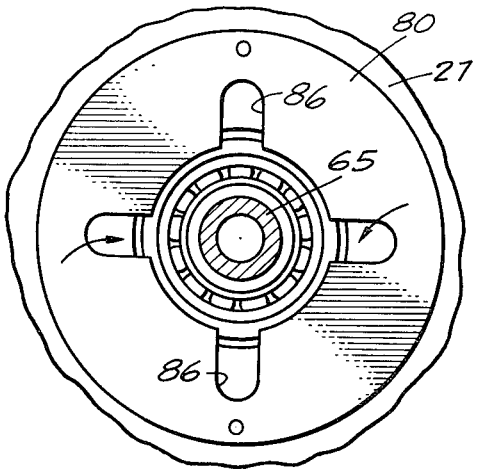
FIG. 4 is a top plan, sectional view taken along the line 4—4 of FIG. 3.
Figure 9:
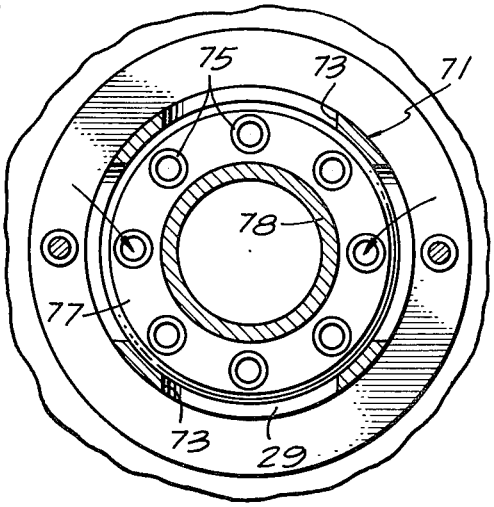
FIG. 9 is a top plan sectional view taken along the line 9—9 of FIG. 7.

Turning now to the drawing and particularly to FIG. 1 thereof, the gas compressor of this invention is enumerated generally as at 10 and is seen to be of a substantially cylindrical structure with the air to be compressed entering at one circular end 11 and after one stage of compression exits via a suitable axially located fitting 12 at the opposite circular end 13. Rotary driving power from a source (not shown) is applied to an axial shaft 14 in the circular end 11 which, depending upon the operational mode of a planetary gear assembly 15, drives a rotor 16 and circumferentially arranged gear 17 either clockwise or counterclockwise. A pair of shafts 18 and 19 having their ends journaled in the end walls 11 and 13 are individually drivingly related to the gear 17 by spur gears 20 and 21, respectively. The lower portions of these shafts are threaded as at 22 and 23, and received within threaded nuts of an annular piston 24 for driving the piston with the compressor cylinder 25, the latter having its sides defined by a hollow cylindrical housing 26.

The housing side wall 26 with the two circular end walls 11 and 13 form the entire housing for the compressor. The cylinder 25 which is in the lower half of the compressor as depicted in FIG. 1, is defined by the cylindrical side wall 26, the circular end wall 13 and a substantially centrally located partition wall 27. The annular piston 24 is double acting in that as it drives in either direction air is compressed and forced outwardly of either the top set of ports 28 or the lower set of ports 29 to exit at outlet 12.

Planetary Gear Reciprocal Drive

Figure 3:
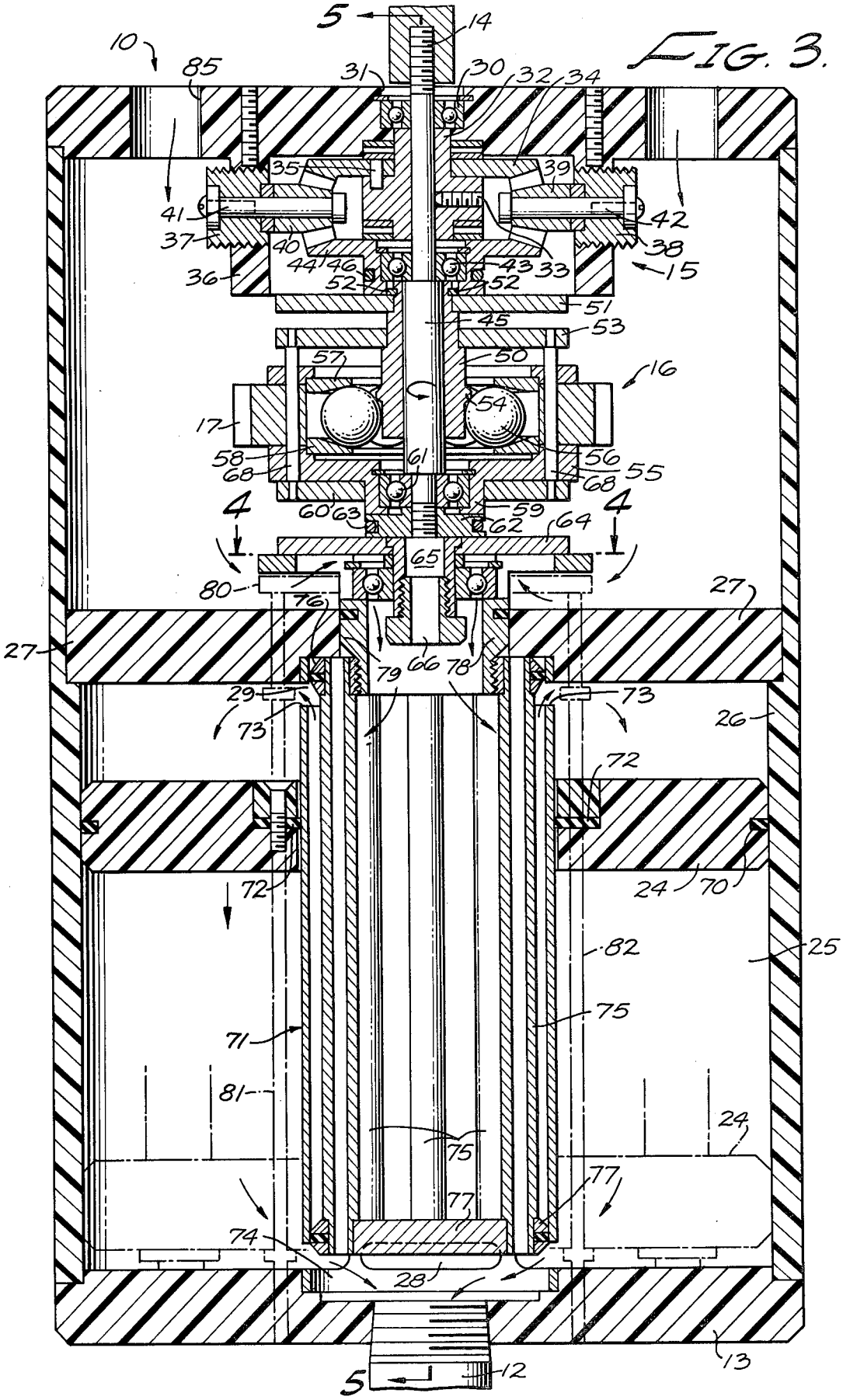
FIG. 3 is a side elevational, full sectional view taken along the line 3—3 of FIG. 1.

For the ensuing description of the planetary gear system 15 and its operation to effect cyclic change of rotational drive from a constant direction input rotation, reference is now made to FIG. 3. As shown, the input rotative power is constant and in the direction shown by the arrow. The input shaft 14 is received through a thrust bearing 30 fitted into an opening 31 in the upper circular end plate 11. Hub means 32 is received on the shaft 14 inwardly of bearing 30 and secured to the shaft by threaded member 33. A sun gear 34 is received on an appropriately dimensioned part of the hub means and secured thereto by a pin 35, the sun gear being part of the planetary gear assembly 15. In this manner, rotation of the shaft 14 simultaneously rotates the hub means 32 and sun gear 34.

A cylindrical wall 36 integral with the end plate 11 extends axially inwardly and is concentric about the shaft 14. Threaded plugs 37 and 38 are received within the cylindrical wall 36 and serve as means to which first and second planetary gears 39 and 40 are rotatably journaled via stub shafts 41 and 42, respectively. These planetary gears are located to mesh with the sun gear 34 throughout its full range of rotation.

Figure 7:
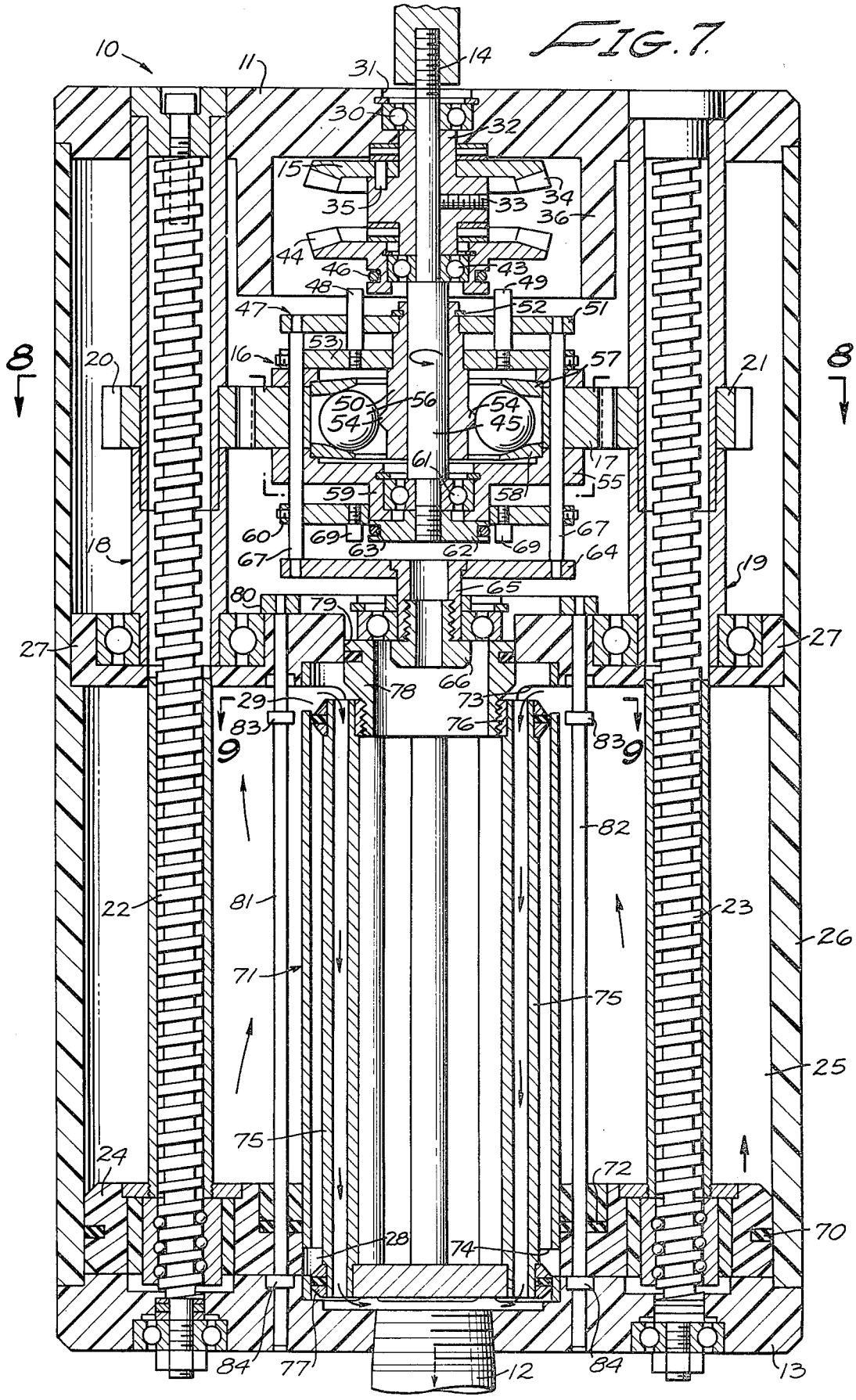
FIG. 7 is a side elevational, sectional view similar to FIG. 5 only at a different stage of operation.

Referring momentarily to both FIGS. 3 and 7, a further thrust bearing 43 journals a second sun gear 44 onto the shaft 14 at the shoulder formed at the junction with a larger shaft diameter portion 45. It can be seen that this further sun gear 44 rotates freely about the shaft 14 while remaining meshed with the planetary gears 39 and 40.

As will be more particularly decribed later herein, a coil spring clutch 46 which is received within a peripheral groove of the hub of sun gear 44 upon engagement and disengagement with clutch actuating parts causes the planetary gear assembly to first produce rotation in same direction as that of shaft 14 and then oppositely.

Reversing Clutch Operation

Figure 5:
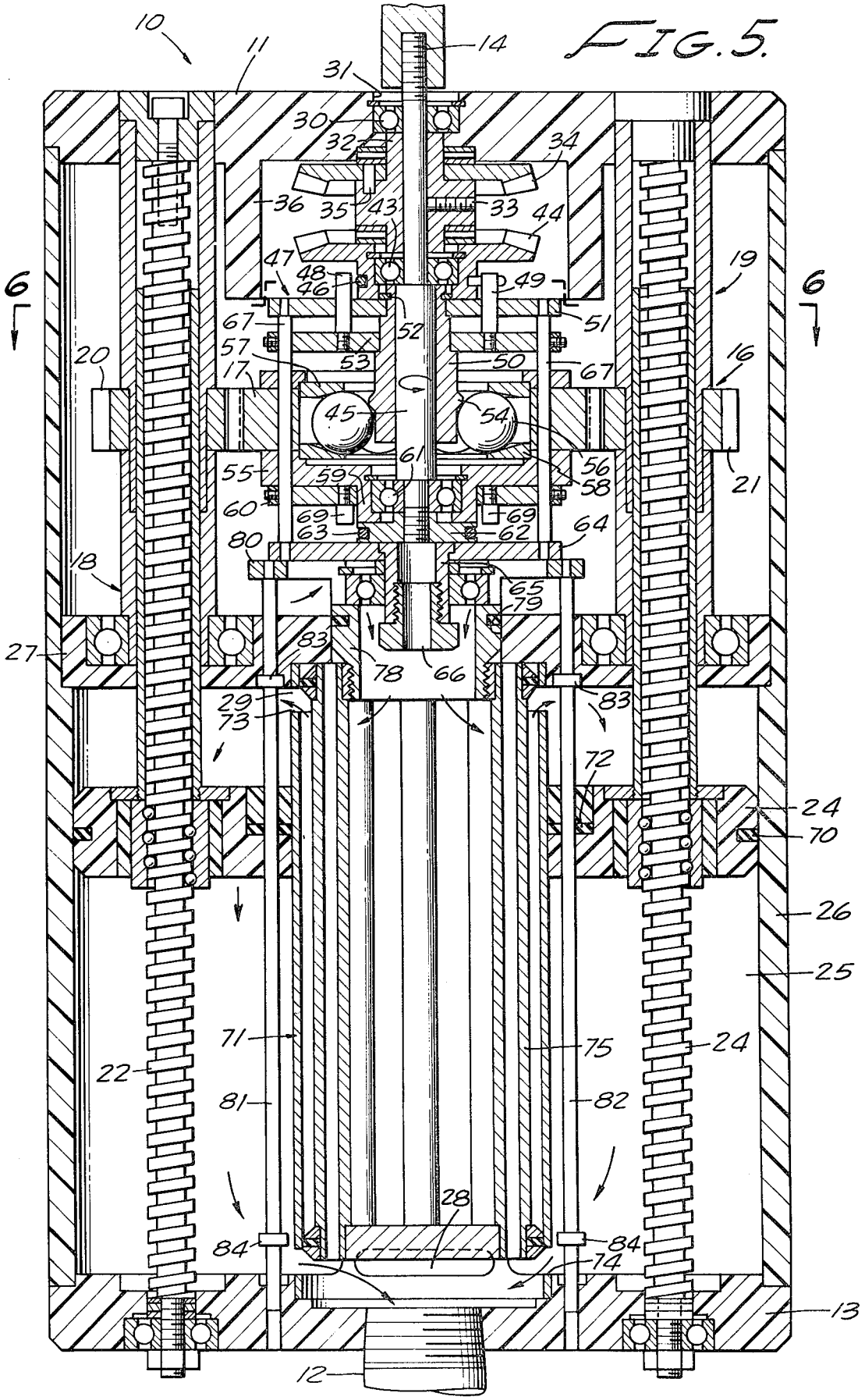
FIG. 5 is a further side elevational sectional view taken along the line 5—5 of FIG. 3.

The reversing clutch means identified as 47 and seen best on comparison of FIGS. 5 and 7, is a collection of apparatus having a generally cagelike appearance that moves in a reciprocating path parallel to the axis of the shaft 14 to locate the end portions of pins 48 and 49 into and out of obstructing relation with the outer end of clutch spring 46. Accordingly, the rotor 16 rotates first clockwise and then counterclockwise, depending upon the clutch mode, to drive the shafts 18 and 19, and thus the annular piston 24, first in one direction and then in the other. An elongated slide 50 has a bore permitting sliding receipt on the large diameter shaft portion 45. A first generally cylindrical clutch end plate 51 is secured onto a relatively small diametral end portion of slide 50 by washer 52. The outer diameter of the plate 51 is substantially equal to but slightly less than the bore diameter formed by the walls 36 in end plate 11.

Spaced along the slide 50 from the end plate 51 there is located a further plate 53 of substantially the same construction as end plate 51 abutting against a shoulder on the slide whereby it is affixed at a constant spacing from the end plate. The remainder of the slide 50 is of a larger diameter and it includes at a point spaced inwardly from its lowermost end a circumferentially extending ridge 54 for a purpose and use to be described.

The annular member 55 forms the rotor 16 and has the circumferentially extending spur gear 17 arranged completely thereabout. An enlarged bore in the member 55 permits ready receipt onto the slide 50. A set of ball bearings 56 are held in a race located on the interior side wall of the member 55 by first and second canted annular leaf spring means 57 and 58 which continuously urge the ball bearings toward the slide 50. As will be described in more detail, the spring means permit the ball bearings to pass over the circumferential ridge 54 and by the spring action serve to positively locate the slide and associated equipment at one side or the other of the ridge.

Annular member 55 has a hub 59 which slidingly extends through an axial opening in a circular plate 60, the latter being constructed substantially identically to plate 53. A ball bearing race 61 rotatively journals the annular member 55 to the lower reduced diameter end of the shaft 14. An end cap 62 is threadedly secured on the end of the shaft 14 and a further spring wire clutch 63 located in a circumferential groove on the cap.

A bottom plate 64 of the cagelike assembly is circular and substantially identical to the end plate 51 and includes an axial opening within which a ferrule 65 is seated. The ferrule extends downwardly from the plate 64 and terminates in a member 66 with an enlarged head, which member is threaded into the ferrule.

A plurality of rods 67 have their ends affixed into receiving openings in the end plates 51 and bottom plate 64, respectively, thereby maintaining these parts at a constant spacing. Also, the plates 60 and 53 are maintained at a fixed spaced relation to each other by a plurality of rods 68 (FIG. 3). The clutch pins 48 and 49 as shown in FIG. 5 are movable to an obstructing position in which the clutch spring 46 on rotation with the sun gear 44 engages the pin. Similarly, a further pair of pins 69 extend downwardly from the plate 60 and can be brought into obstructing relationship with the spring wire clutch 63 as is shown in FIG. 7, or to a position free from obstructing the wire clutch as shown in FIG. 5. It is to be noted that when the clutch assembly is in the mode where clutch pins 48 and 49 are in obstructing relation to the spring wire clutch 46, the pins 69 are free from obstructing relation to the spring wire clutch 63. Also, when the pins 48 and 49 do not obstruct the spring wire clutch, the pins 69 are in obstructing relationship. These two situations represent the two modes of clutching and produce a corresponding different direction of rotation of the rotor 16 for each mode and thus for the direction of drive of the annular position 24.

Figure 10A:
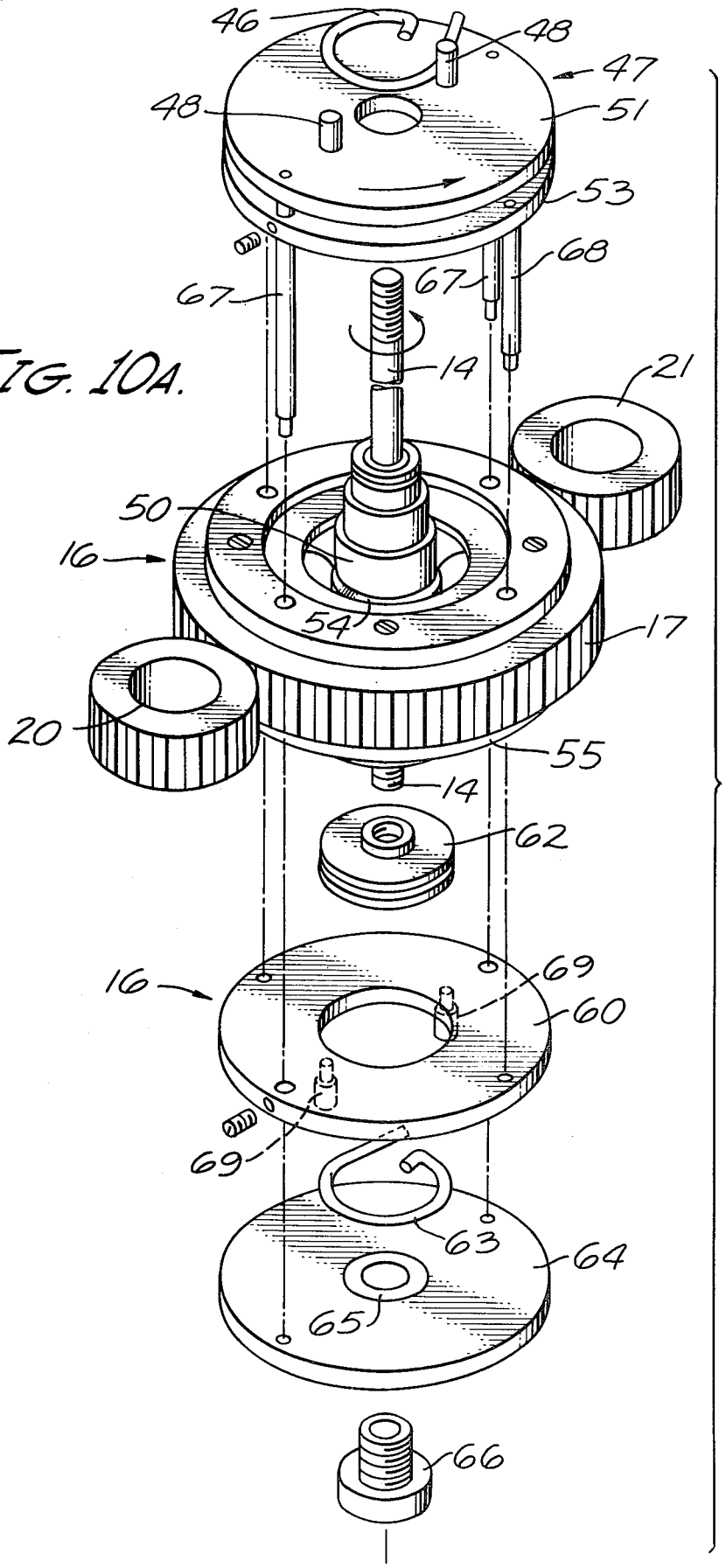
FIGS. 10A and 10B are perspective exploded views of the top drive and spring clutch means, and cylinder and clutch actuating means, respectively.
Figure 10B:
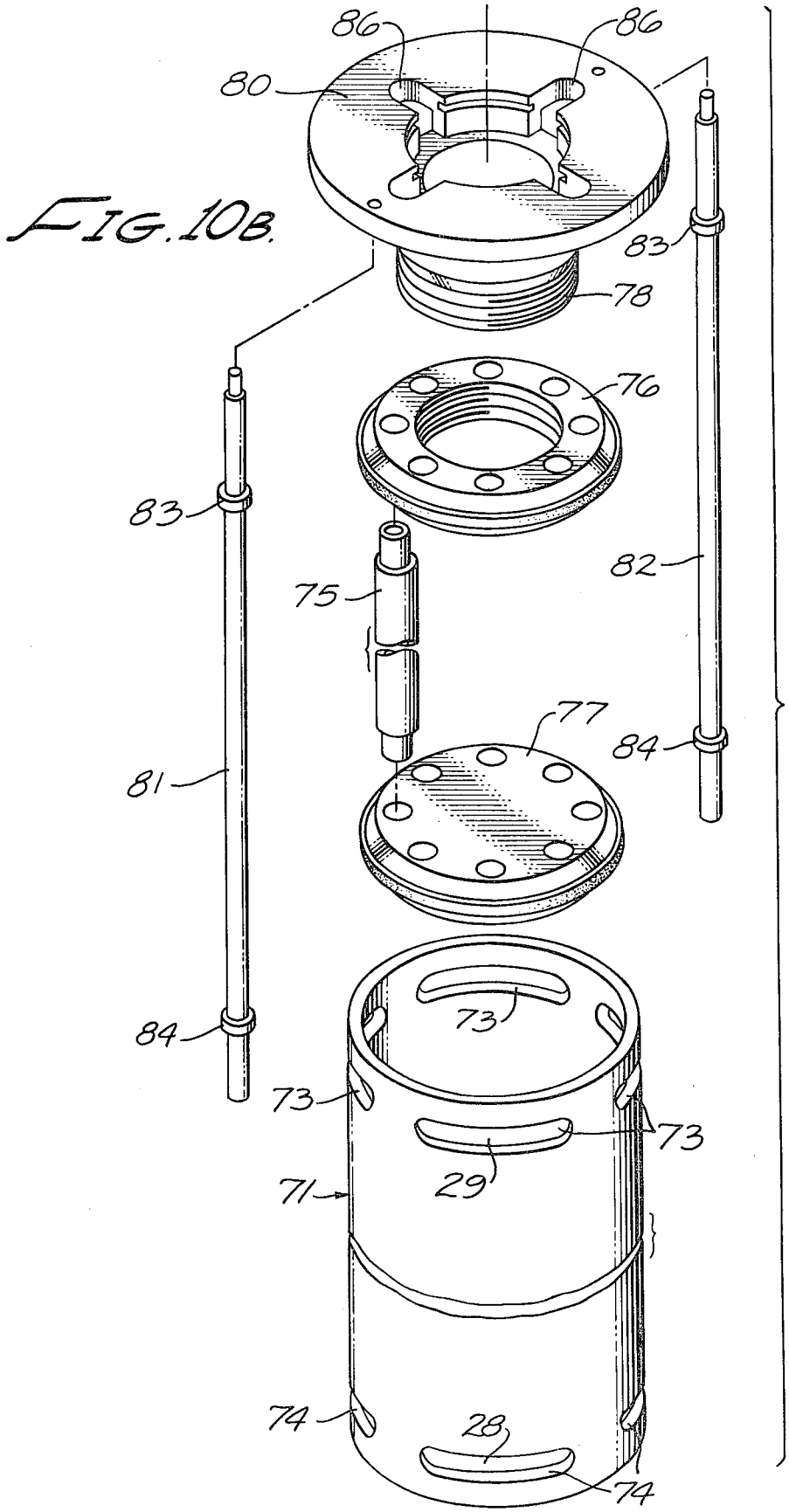

FIG. 6 shows the direction of drive of the spur gears 20, 21 (and thus shafts 18, 19) on engagement of the spring wire clutch 46. Similarly, FIG. 8 depicts driving relation effected on engagement of the spring wire clutch 63. The exploded view of FIG. 10A also shows the overall relationship of the two spring wire clutches for effecting rotational drive control.

Compressor Air Porting

For the ensuing description of air porting reference is made once again primarily to FIG. 3. The annular piston 24 is fittingly received within the cylinder 25 and includes a circumferentially extending sealing means 70 which prevents air leakage therepast. In addition, the central bore of the piston is slidingly related to an elongated hollow cylinder 71 for an air seal 72. The tube 71 has its ends secured within receiving wells in the partition wall 27 and bottom circular end wall 13, respectively. A plurality of mutually spaced, horizontally elongated slots 73 in tube 71 are located closely adjacent partition wall 27 and serve as the upper porting means 29 via which air is moved into and out of the compressor or cylinder above the annular piston. Similarly, a further plurality of mutually spaced, horizontally elongated slots 74 located closely adjacent the lower end wall 13 acts as the lower air porting means 28 for the cylinder space below the piston.

A plurality of hollow tubes 75 are arranged in a circle and vertically extending within the larger cylinder 71. The upper end of the tubes 75 are fixedly received within a ring 76 which is sealingly and slidingly located within the cylinder 71, while the lower end of the tubes are secured within a circular plate 77 the peripheral edges of which slidingly and sealingly abut against the inner wall of cylinder 71. It is important to note that the tubes 75 are open at both ends and can, therefore, pass air therethrough unless closed off in a manner to be described during valving.

A sleeve 78, threaded or otherwise secured to the ring 76, sealingly slides within an axial opening 79 in partition wall 27. An enlarged flat upper surface drive plate 80 is located above the partition and is integral with the sleeve 78. That is, the drive plate 80, sleeve 78, ring 76, set of tubes 75 and plate 77 all move as a unit axially within the cylinder 25 and 71.

First and second drive rods 81 and 82 (FIG. 7) are located within the cylinder inwardly of the respective threaded shafts 22 and 23 and parallel thereto. The end portions of the drive rods are slidingly received within openings in the partition 27 and the lower end wall 13 while the upper ends are secured in drive plate 80. More particularly, each drive rod includes a pair of stops 83 and 84 adjacent the partition and lower end wall, respectively, which are contacted by the annular piston during its movement and utilized to move the drive rods.

One extreme of the drive rods position is that shown in FIG. 7 where the annular piston is at its lowermost and the upper ends of the drive rods are below the upper surface of the partition wall. In arriving at this position, the drive plate 80 has pulled down on the large-headed member 66 which, in turn, disengages pins 48 and 49 from spring clutch 46 and engages pin 69 with spring clutch 63. The rotor 16 is now rotated in such direction as to move the annular piston upwardly on the threaded drive shafts. Also at this time air above the piston is forced through the upper ports 73 into the hollow tubes 75 and finally out at 12.

Figure 2:
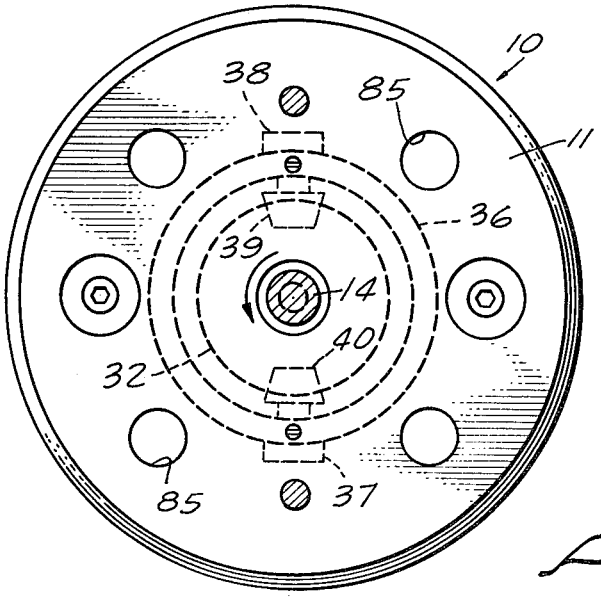
FIG. 2 is a top plan view taken along the line 2—2 of FIG. 1.

At the upper extreme of piston movement the drive rods are moved to the position shown in FIG. 5 which causes the drive plate 80 to move the plate 64 upward engaging the pins 48 and 49 with spring clutch 46 and at substantially the same time disengaging pins 69 from the lower spring clutch 63. The annular piston is now being driven downwardly with pressurized air below being forced out the ports 74. Incoming air to the cylinder above the piston moves through openings 85 in the top end plate (FIG. 2), openings 86 in the drive plate 80, bore of sleeve 78, and space between tubes 75 and ports 73. The changing of the valving of the tubes 75 from the FIG. 7 to FIG. 5 condition is effected by the drive plate 80 on moving upwardly pulling the ring 76 and hollow tube assembly upwardly with it.

Consecutive operation of the compressor as described in the preceding paragraphs provides compressed air at outlet 12 on each stroke of the piston. The cylindrical construction of the compressor with air inlet and outlet being at the respective circular ends makes the compressor ideal for in-line operation.

I claim:

1. An air compressor driven by a unidirectional rotational power source, comprising:

a hollow, generally cylindrical housing including a partition wall separating the interior into a first chamber in which air compression occurs and a second chamber, and first and second end walls enclosing the housing interior;

tubular means extending along the cylindrical axis from the partition to the end wall within the housing first chamber and including first and second port means adjacent said partition and said end wall, respectively;

an annular piston located in said first chamber and slidingly received on the tubular means;

first and second shafts threadedly meshing with nut means on said piston, said shafts having portions extending into both the first and second chambers;

a drive gear mounted within the housing second chamber;

first and second gears affixed respectively to the first and second shafts and meshed with the drive gear;

alternating clutch means interrelating the rotational power source and the drive gear for consecutively driving the annular piston between two extreme points within the second chamber;

air valving means having a first mode interconnecting a source of ambient air to the first port means and the second port means to an outlet fitting in the housing, and a second mode interconnecting the source of ambient air to the second port means and the first port means to the outlet fitting; and means driven by the annular piston for consecutively actuating the alternating clutch means and air valving means.

2. An air compressor as in claim 1, in which the rotational power source is applied axially at one housing end wall and the compressed air outlet is in the other end wall.

3. An air compressor as in claim 1, in which the air valving means includes a plurality of hollow tubes arranged generally cylindrically each having one end affixed to a ring and the opposite end to a plate, the bore of said tubes extending through both the ring and plate; said hollow tube arrangement being translatable within the tubular means between a first mode interconnecting the first port means with the pressurized air outlet fitting and the second port means with the ambient air, and a second mode interconnecting the first port means with ambient air and the second port means with the pressurized air outlet fitting.

4. An air compressor as in claim 1, in which the alternating clutch means includes first shaft means interconnecting the rotational power source and a first sun gear of a planetary gear assembly; second shaft means interconnected with a second sun gear; planetary gears meshing with the first and second sun gears; first and second spring wire clutches interrelating the first sun gear and the second sun gear with the drive gear, respectively; said spring wire clutches being consecutively and oppositely actuated by the annular piston driven means.

5. An air compressor as in claim 4, in which the annular piston driven means includes at least one rod slidingly extending through an opening in the piston and having a stop at each side of the piston whereby the piston on contacting a stop moves the driven means accordingly, means carrying first and second pin means being consecutively moved by said piston driven means to engage the first wire clutch with the first pin means while leaving the second wire clutch disengaged and to engage the second wire clutch with the second pin means while leaving the first wire clutch disengaged.

* * * * *